US010550558B2

(12) United States Patent
Cagliari et al.

(10) Patent No.: US 10,550,558 B2
(45) Date of Patent: Feb. 4, 2020

(54) SINK AND METHOD OF INSTALLING SAME

(71) Applicant: Franke Technology and Trademark Ltd, Hergiswil (CH)

(72) Inventors: Alessandro Cagliari, Peschiera del Garda (IT); Christian W. Bomatter, Willer (FR); Rolf Neeser, Reidermoos (CH)

(73) Assignee: FRANKE TECHNOLOGY AND TRADEMARK LTD, Hergiswil (CH)

( * ) Notice: Subject to any disclaimer, the term of this patent is extended or adjusted under 35 U.S.C. 154(b) by 0 days.

(21) Appl. No.: 15/662,863

(22) Filed: Jul. 28, 2017

(65) Prior Publication Data

US 2018/0030703 A1 Feb. 1, 2018

Related U.S. Application Data

(60) Provisional application No. 62/371,408, filed on Aug. 5, 2016.

(30) Foreign Application Priority Data

Jul. 28, 2016 (EP) ..... 16181575

(51) Int. Cl.
*E03C 1/33* (2006.01)
*A47B 77/06* (2006.01)
*E03C 1/18* (2006.01)

(52) U.S. Cl.
CPC ..... *E03C 1/33* (2013.01); *A47B 77/06* (2013.01); *E03C 1/18* (2013.01)

(58) Field of Classification Search
CPC ..... E03C 1/33; A47K 1/05; A47B 77/06
(Continued)

(56) References Cited

U.S. PATENT DOCUMENTS 2,080,573 A * 5/1937 Sern ..... A47B 77/06 4/631
2,858,548 A * 11/1958 Switzer ..... E03C 1/33 126/211

(Continued)

FOREIGN PATENT DOCUMENTS

AT 393075 8/1991
CA 2622792 9/2009

(Continued)

OTHER PUBLICATIONS

Machine Translation of EP '825. Espacenet. (Year: 2019).*

*Primary Examiner* — Erin Deery
(74) *Attorney, Agent, or Firm* — Volpe and Koenig, P.C.

(57) ABSTRACT

A method of installing a sink in a worktop cut-out, including: (a) providing a sink with: a bowl with a bottom wall and a circumferential side wall; at least one outlet opening located in the bottom; a circumferential rim located at an upper edge of the bowl and extending outwardly from the side wall by an extent (E); resilient clamping elements arranged on the outside of the bowl adjacent the rim, that in a free or uncompressed state, extend outwardly beyond the extent (E), and which provide, in a loaded state, a clamping force outwardly from the side wall; (b) making the worktop cut-out larger in dimension than a rim area but smaller than an envelope around the uncompressed clamping elements while defining a cut-out side wall extending at right angles to upper and lower surfaces of the worktop; (c) placing the sink in the cut-out so that the cut-out side wall is located opposite the rim, the sink being centered within the cut-out by the clamping elements, which are compressed between the cut-out side wall and the sink.

7 Claims, 6 Drawing Sheets

(58) Field of Classification Search
USPC ..... 4/631–634, 649
See application file for complete search history.

(56) References Cited

U.S. PATENT DOCUMENTS

| | | | | |
|---|---|---|---|---|
| 3,071,780 | A * | 1/1963 | Lyon, Jr. | E03C 1/33 292/80 |
| 3,585,657 | A * | 6/1971 | Jensen | E03C 1/33 4/633 |
| 5,177,853 | A | 1/1993 | Herook | |
| 6,311,345 | B1 | 11/2001 | Limbach | |
| 6,591,468 | B1 | 7/2003 | Douglas | |
| 6,782,593 | B1 * | 8/2004 | Shimony | B28B 15/00 29/401.1 |
| 6,793,190 | B2 * | 9/2004 | White | E03C 1/33 248/500 |
| 7,523,511 | B2 * | 4/2009 | Marr | E03C 1/33 4/633 |
| 8,070,562 | B1 | 12/2011 | Murrer | |
| 9,803,347 | B2 * | 10/2017 | Hocaoglu | E03C 1/18 |
| 2005/0039254 | A1 | 2/2005 | Brown | |
| 2007/0151019 | A1 | 7/2007 | Marr et al. | |
| 2013/0019443 | A1 | 1/2013 | Gomes | |

FOREIGN PATENT DOCUMENTS

| | | | | |
|---|---|---|---|---|
| CN | 1299430 | A | 6/2001 | |
| CN | 104895163 | | 9/2015 | |
| EP | 0307825 | A1 * | 3/1989 | E03C 1/33 |
| EP | 1772566 | | 10/2006 | |
| EP | 2884013 | | 6/2015 | |

* cited by examiner

SINK AND METHOD OF INSTALLING SAME

INCORPORATION BY REFERENCE

The following documents are incorporated herein by reference as if fully set forth: European Patent Application No. 16181575.8, filed Jul. 28, 2016; and U.S. Provisional Patent Application No. 62/371,408, filed Aug. 5, 2016.

BACKGROUND

The present application relates to a sink, in particular a kitchen sink.

According to a further aspect, the application relates to a (kitchen) workplace comprising a sink and a worktop, said worktop having a cut-out therein, in which said sink is installed.

Furthermore, according to another aspect thereof, the application relates to a method of installing a sink in a worktop cut-out.

Finally, according to yet another aspect, the application relates to a device for installing a sink in a worktop cut-out.

Today, different installation methods are used for installing sinks, in particular kitchen sinks, in a built-in kitchen.

Using the undermount method, the sink has outwardly directed flanges along its side walls, which flanges are fixed to the lower surface of a worktop by means of brackets or the like. Accordingly, with the undermount method, the sink has to be installed from below the worktop which may be cumbersome and difficult.

So-called inset or slimtop sinks present an edge portion around the sink bowl, which edge portion is intended to be placed on top of the upper worktop surface when installing the sink. The sink in question further presents clamps which are—on one side—attached to said edge portion, whereas the other extremity of said clamps is brought into contact with the lower worktop surface. Then, by means of screws comprised in said clamps, the sink is fixed to the worktop. Again, the main installation work has to be done from below the worktop, which can be cumbersome and difficult. Furthermore, said clamps can present a rather intricate design.

So-called flushmount sinks differ from the above-mentioned inset or slim top sinks in that said edge portion of the sink is not located on top of the upper worktop surface, but is located in a shallow circumferential recess around a worktop cut-out. In this way, the sink does not protrude from the upper worktop surface, which can be appreciated for reasons of design and hygene. Flushmount sinks are fixed to the worktop by clamps, much like inset or slim top sinks.

SUMMARY

It is an object of the present invention to provide a new sink and a corresponding installation method, which present a unique integration of the sink with the worktop, while facilitating the installation work. Furthermore, a cut-out section of the worktop shall be protected, which is not easily possible with the above-mentioned current installation methods.

The object is achieved by a sink having one or more features of the invention, in particular kitchen sink, comprising: at least one bowl with a bottom wall and a circumferential side wall; at least one outlet opening located in said bottom wall; a circumferential rim located at an upper edge of said bowl around an outside thereof, said rim extending outwardly from said side wall by an extent; a number of resilient clamping elements arranged on the outside of said bowl adjacent said rim, which clamping elements, in a free or uncompressed state thereof, extend outwardly beyond the extent of said rim, and which clamping elements are devised for providing, in a loaded or compressed state thereof, a clamping force outwardly from said side wall.

According to another aspect of the invention, the object is achieved by a workplace having one or more features of the invention, said workplace comprising a sink, in particular kitchen sink, said sink comprising: at least one bowl with a bottom wall and a circumferential side wall; at least one outlet opening located in said bottom wall; a circumferential rim located at an upper edge of said bowl around an outside thereof, said rim extending outwardly from said side wall by an extent; a number of resilient clamping elements arranged on the outside of said bowl adjacent said rim, which clamping elements, in a free or uncompressed state thereof, extend outwardly beyond the extent of said rim, and which clamping elements are devised for providing, in a loaded or compressed state thereof, a clamping force outwardly from said side wall; and a worktop, said worktop having a cut-out therein, in which said sink is installed, said cut-out defining a cut-out side wall extending essentially at right angles with respect to an upper and lower surface of said worktop, wherein said cut-out side wall is located opposite said rim, and wherein said sink is centered within said cut-out by means of said clamping elements, which are compressed between said cut-out side wall and said sink.

According to a further aspect of the invention, the object is also achieved by a method of installing a sink in a worktop cut-out including one or more features of the invention, said method comprising a) providing a sink with: at least one bowl with a bottom wall and a circumferential side wall; at least one outlet opening located in said bottom wall; a circumferential rim located at an upper edge of said bowl around an outside thereof, said rim extending outwardly from said side wall by an extent; a number of resilient clamping elements arranged on the outside of said bowl adjacent said rim, which clamping elements, in a free or uncompressed state thereof, extend outwardly beyond the extent of said rim, and which clamping elements are devised for providing, in a loaded or compressed state thereof, a clamping force outwardly from said side wall; b) making said worktop cut-out, it being larger in dimension than an area circumscribed by said rim but smaller than an envelope around said clamping elements in their uncompressed state while defining a cut-out side wall extending essentially at right angles with respect to an upper and lower surface of said worktop; c) placing said sink in said cut-out so that said cut-out side wall is located opposite said rim, said sink being centered within said cut-out by means of said clamping elements, which are compressed between said cut-out side wall and said sink.

According to yet a further aspect of the present invention, the object is achieved by a device for installing a sink in a worktop cut-out having one or more features of the invention, said sink comprising at least one bowl with a bottom wall and a circumferential side wall; at least one outlet opening located in said bottom wall; a circumferential rim located at an upper edge of said bowl around an outside thereof; said device comprising at least one installing jig for placing on an upper face of said rim and extending coplanar with said upper face of said rim while extending, at least locally, beyond said rim outwardly from said sink, and a jig counterpart for removably fixing said installing jig to said sink.

Due to its unique rim design, the sink according to the present invention is capable of breaking current installation rules. Preferably, the rim extends across the worktop cut-out section, thus potentially protecting the latter, and an upper edge of said rim is coplanar with the upper worktop surface, when installed.

In this way, a side wall of the worktop cut-out can be protected and does not require to be polished or otherwise treated prior to installing the sink, which can greatly reduce installation costs.

Preferably, the sink rim is floating in the worktop cut-out, i.e. does not come into contact with a side wall of said cut-out. A corresponding gap can be sealed by using any suitable sealant, e.g. a silicone sealant.

Installation of the sink according to the present invention can be executed by pushing the sink in the worktop cut-out from above the worktop, preferable by using a suitable installation device according to one aspect of the present invention.

The sink can be kept in its final position within the worktop cut-out by the resilient clamping elements arranged on the outside of the sink bowl (so-called fastfix clips) in combination with the adhesive action of said sealant (e.g. silicone).

As a final result, the installed sink can present a flush-mount-like rim in terms of alignment with the worktop upper surface, while greatly facilitating the required installation work.

Due to the mentioned installation method, the rim of the sink according to the present invention can be much thinner than standard in the market, e.g. 4 mm vs. 15 through 30 mm, which can be seen as advantageous in terms of esthetics. Thus, in a preferred embodiment of the sink according to the present invention, a value of the extent by which the sink rim extends outwardly from the sink side wall is comprised between 2.5 mm and 6 mm, preferably between 2.5 mm and 5 mm, and more preferably equals about 4 mm, as mentioned.

In another embodiment of the sink according to the present invention, said rim can be configured in solid material or can be configured by outward and downward bending of the side wall material used for production of the sink.

In yet another embodiment of the sink according to the present invention, said clamping elements are compressible inwardly towards said side wall to an extent that they do not extend outwardly beyond said extent of the rim. In this way, an easy installation of the sink in a worktop cut-out from above the worktop is made possible.

According to yet another embodiment of the sink according to the present invention, a clamping force per unit length of the side wall, as caused by said clamping elements in said loaded or compressed state thereof, is essentially evenly distributed around the sink, preferably by adapting a number of the clamping elements and/or by adapting a mutual spacing between individual clamping elements and/or by adapting the clamping force of individual clamping elements. In this way, it can be easily made possible to self-center the sink during insertion in the worktop cut-out by means of said clamping elements. This can help to achieve a uniform gap around the sink, which is advantageous in terms of sealing said gap as well as in terms of esthetics.

According to a further embodiment of the sink according to the present invention, individual clamping elements comprise at least one spring element, which is hook-shaped in cross-section, with a first leg extending essentially parallel to said side wall and preferably downwardly from said rim, a second leg extending outwardly from said first leg and from said side wall, and a third leg extending outwardly from said second leg and from said side wall as well as parallel to said first leg, in said free or uncompressed state of the clamping elements, said third leg at least partially overlapping with said first leg. This can further help to facilitate installing the sink from above the worktop, while ensuring a reliable clamping action for holding the sink within the worktop cut-out during installation and prior to effectiveness of an additional adhesive material used for fixing the sink in the worktop cut-out.

In order to further enhance the clamping effect, according to a preferred further embodiment of the sink according to the present invention, a free end portion of said third leg is further angled outwardly from said side wall.

For easy installation and for achieving an esthetical effect, the sidewall of the sink can have an essentially flat configuration. Furthermore, the sink as such can have an overall rectangular shape, when seen from above, preferably with rounded corners.

In a preferred further embodiment of the workplace according to the present invention, a distance between said rim and said worktop cut-out side wall can be essentially uniform around said sink for achieving a superior esthetical effect. This has already been mentioned above and can be achieved by means of adapting the clamping force per unit length of the sink side wall, as detailed above.

In yet another embodiment of the workplace according to the present invention, an adhesive sealing joint is located around said rim between said sink and said cut-out side wall, preferably a silicone joint or the like. While filling the gap between the floating rim and the cut-out side wall, said joint can be devised to durably hold the sink in place within the worktop cut-out, in combination with a clamping action of the clamping elements. Accordingly, a main effect of the clamping elements can be to center the sink during installation thereof and to hold it in place until the adhesive sealant has set (or cured).

According to yet another embodiment of the workplace according to the present invention, an upper face or upper edge of said rim can be essentially coplanar with the upper worktop surface, thus achieving a superior esthetical and hygenical effect.

As already mentioned before, an embodiment of the inventive method can comprise placing the sink in the worktop cut-out from above the worktop, beginning with a bottom part of the sink, which bottom part is located opposite said rim. This may greatly facilitate installation of the sink, in particular in comparison with current undermount methods.

In yet another embodiment of the method according to the invention, said method may comprise placing the sink in the worktop cut-out and lowering it therein until an upper face of said rim is essentially coplanar with the upper surface of the work top.

Prior to method step c), in yet another further embodiment of the inventive method, a bead of an adhesive sealing material can be placed around the rim, preferably a silicone material or the like, so that, during method step c), an adhesive sealing joint is formed around the rim between the sink and the cut-out side wall, preferably a silicone joint or the like. The joint can be effective to close the gap between the sink rim and the cut-out side wall, while protecting the latter from moisture or the like. Furthermore, the adhesive sealing material will hold the sink in place after curing or setting.

In yet a further embodiment of the inventive method, prior to step c), the sink can be provided with a removable installation device, said installation device comprising at least one installing jig placed on an upper face of the sink rim and extending essentially coplanar with said upper face of said rim while extending, at least locally, beyond said rim outwardly from the sink. Then method step c) can be performed until said installing jig comes into contact with said upper worktop surface. Afterwards, the installation device can be removed. In this way, the above-described embodiment of the inventive method enables flushmount-like installation of the sink in an easy and reliable fashion.

For protecting the worktop surface, in particular from said sealing material, prior to method step c), in a further embodiment of the inventive method, the worktop can be provided on its upper surface, adjacent a contour of the cut-out, with a removable protective cover, in particular a tape, which protective cover can be removed after completion of step c).

A further embodiment of the installation device according to the present invention comprises that the counterpart of said installing jig is to be located at the sink outlet opening on an outside of the sink bowl. Therefore, said counterpart can be devised accordingly.

Preferably, said counterpart, in a further embodiment of the inventive device, can be devised as a plate-like element, a planar dimension of which is bigger than a clear opening of said outlet opening. In this way, said counterpart can be placed over said outlet opening without passing therethrough.

In a further embodiment of the device according to the present invention, the device comprises a connecting means for detachably connecting the installing jig and the counterpart. Preferably, said connecting means are devised as a screw means, so that detachably connecting said installing jig and said counterpart can be readily achieved without the use of any specialized tools or the like.

For detachably connecting said installing jig and said counterpart, according to a further embodiment thereof, the device according to the present invention may comprise corresponding openings in said installation jig and in said counterpart for passing through said connectors.

If said connectors are devised as a screw, in yet another embodiment of the inventive device, at least said opening in said counterpart can be devised as a threaded bore. This further facilitates detachably connecting said installation jig and said counterpart.

According to yet another preferred embodiment of the inventive device, said connecting means may comprise an abutment means, which defines a maximum distance of said installation jig and said counterpart, so that fixing the device on a sink can be achieved in a secure and reliable fashion.

BRIEF DESCRIPTION OF THE DRAWINGS

Further features and advantages of the present invention will now be described in connection with exemplary embodiments thereof with relation to the drawings.

FIGS. 2*a* through 2*d* show the sink of FIG. 1 together with an installation device according to the present invention;

DETAILED DESCRIPTION OF THE PREFERRED EMBODIMENTS

Figure 1:
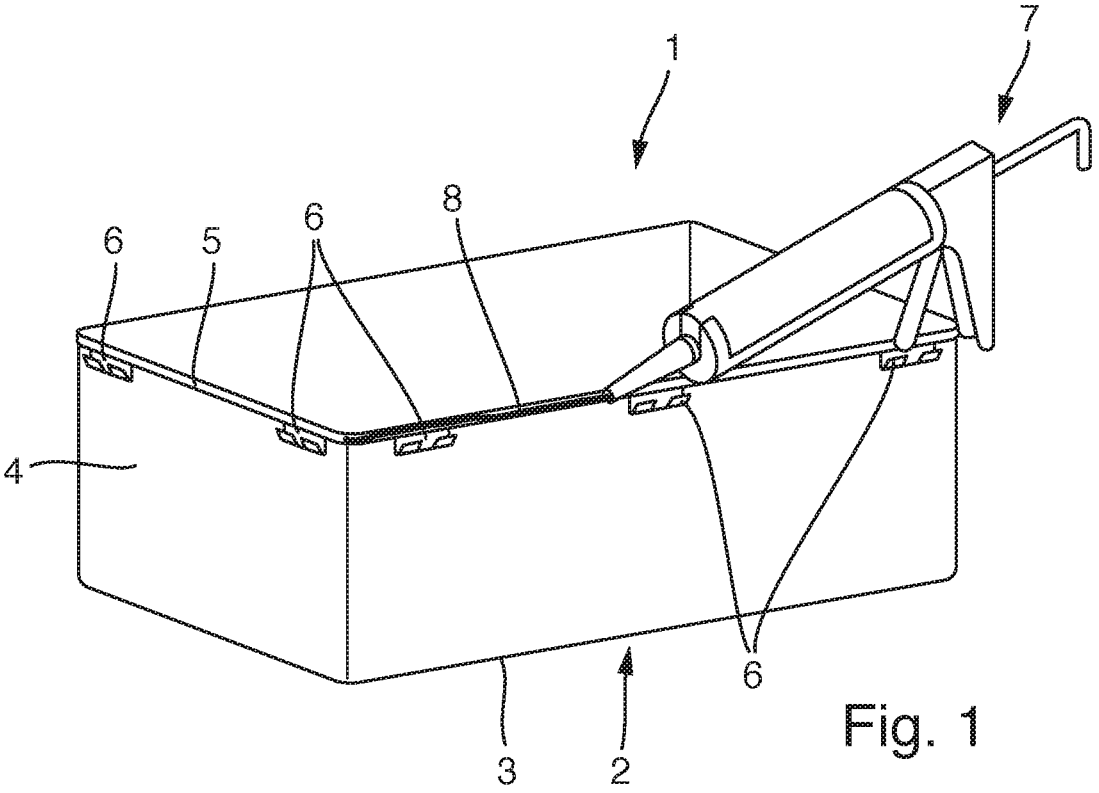
FIG. 1 is a perspective view of a sink according to the present invention, further illustrating the optional method step of placing a bead of an adhesive sealing material around the sink rim.

In FIG. 1, the sink according to the present invention is denoted by means of reference numeral 1. Said sink 1 can—without limitation—be devised as a kitchen sink. It comprises a bowl 2 with a bottom wall 3 and a circumferential side wall 4. At least one outlet opening, which cannot be seen in FIG. 1, is located in said bottom wall 3 (cf. FIG. 2*b*). A circumferential rim 5 is located at an upper edge of said bowl 2 around an outside thereof, as can be readily seen from FIG. 1. Said rim 5 extends outwardly from said side wall 4 by an extent (cf. e.g. FIG. 6). Furthermore, the sink 1 comprises a number of resilient clamping elements 6 arranged on the outside of said bowl 2 adjacent said rim 5. In FIG. 1, said clamping elements 6 are shown in a free or uncompressed state, in which they extend outwardly beyond the extent of said rim 5 (refer to FIGS. 5 and 6 for more details) The clamping elements 6 are devised for providing, in a loaded or compressed state thereof, a clamping force directed outwardly from said side wall 4, for holding the sink in a corresponding worktop cut-out, as will be explained in more detail below.

Figure 6:
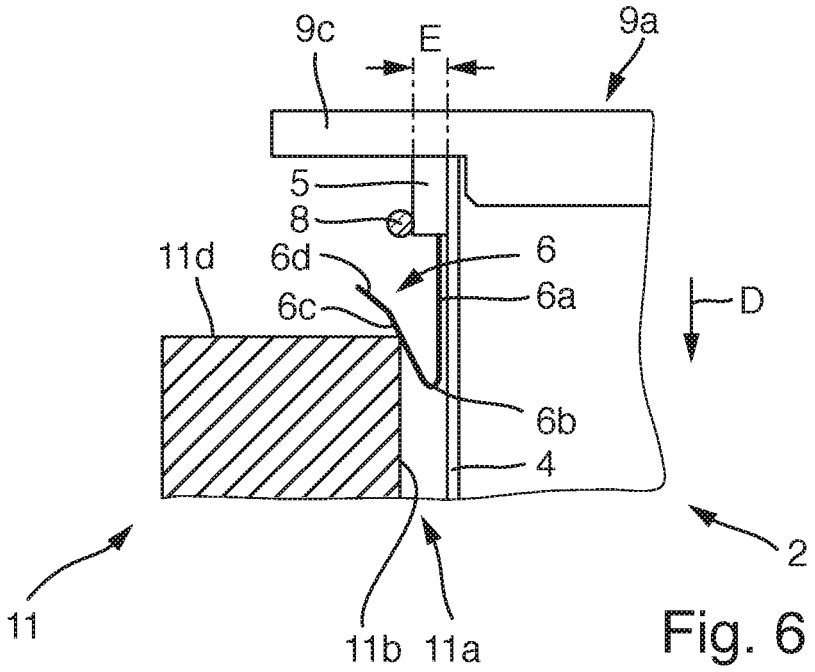
FIG. 6 shows a detail from FIG. 5.

Referring now to FIG. 6, the above-mentioned extent, by which the rim 5 extends outwardly from said side wall 4, has been denoted by reference numeral E. Furthermore, it can be easily gathered from FIG. 6 that the clamping element 6, in its unloaded state, does extend outwardly beyond the extent E of said rim 5. In a preferred embodiment, a value of said extent E can be comprised between 2.5 mm and 6 mm, preferably between 2.5 mm and 5 mm, and more preferably equals about 4 mm.

As can further be gathered from FIG. 6, the clamping elements 6 can comprise at least one spring element which is hook-shaped in cross section, with a first leg 6*a* extending essentially parallel to said side wall 4 and preferably downwardly from said rim 5, a second leg 6*b* extending outwardly from said first leg 6*a* and from said side wall 4, and a third leg 6*c* extending outwardly from second leg 6*b* and from said side wall 4 as well as parallel to said first leg 6*a*, in said free or uncompressed state of the clamping elements 6, as shown in FIG. 6. Furthermore, said third leg 6*c* at least partly overlaps with said first leg 6*a*. A free end portion of said third leg 6*c* is angled outwardly from said side wall 4, as shown at reference numeral 6*d*.

As can further be gathered from FIG. 6, the rim 5 is configured in solid material for increased mechanical strength. Alternatively, it could be configured by outward and downward bending of the side wall 4 material.

Furthermore, from FIG. 6 it can be gathered that the clamping elements 6 are compressible inwardly toward the side wall 4 to an extent that they do no longer extend outwardly beyond said extent E of the rim 5. This enables easy installation of the sink 1 from above a worktop, as will be explained in detail below.

Referring again to FIG. 1, it can be seen that a clamping force per unit length of the side wall 4, as caused by said clamping elements 6 in their loaded or compressed state, is essentially evenly distributed around the sink, by adapting the number of the clamping elements 6. According to the embodiment of FIG. 1, all of the clamping elements 6 are essentially identical; however, more clamping elements have been placed along the longer side walls of the rectangular sink 1, thus enabling centering of the sink 1 within a worktop cut-out. In this context, the number of clamping elements 6 at opposing side walls 4 of the sink 1 should be identical, which cannot be seen in FIG. 1.

Further according to FIG. 1, by use of a suitable device 7, a bead 8 of an adhesive sealing material is placed around the rim 5, which adhesive sealing material can be—without limitation—a silicone material. The effect of said bead 8 will be explained below. Preferably, said bead 8 is placed around the entire periphery of the rim 5 around the sink 1, more preferably with a bead diameter of approx. 7 mm.

FIGS. 2*a* through 2*d* show the sink 1 of FIG. 1 (without bead 8) and its interaction with a special installation device denoted by reference numeral 9. The installation device 9 comprises and installing jig 9*a* and a so-called jig counterpart or counterpart 9*b*. The installing jig 9*a* can be best seen in FIGS. 2*a* and 2*c*, whereas the counterpart 9*b* can be best seen in FIGS. 2*b* and 2*d*. The installing jig 9*a* and its counterpart 9*b* can be made—for instance—in plastic or wood-composite material, without limitation. The installing jig 9*a* has a flat, sheet-like configuration of overall rectangular shape with circumferentially protruding flaps 9*c* and grip openings 9*d*, which are located in vicinity of an edge portion of the installing jig 9*a*. Further comprised are two connecting openings 9*e* which are located near a center of the installing jig 9*a*. As can be seen from FIG. 2*c*, the installing jig 9*a* can be placed on top of the sink 1, so that it rests on an upper edge or upper face of the rim, while said flaps 9*c* protrude outwardly from the sink 1 with respect to the rim. Preferably, the location of each flap 9*c* corresponds to the location of a clamping element 6.

Figure 2A:
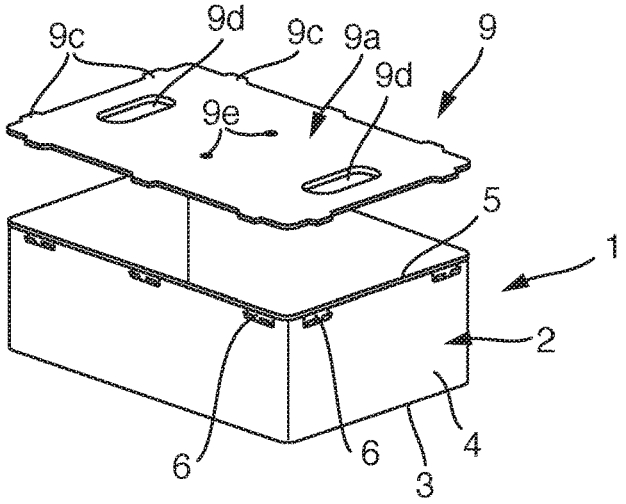
Figure 2C:
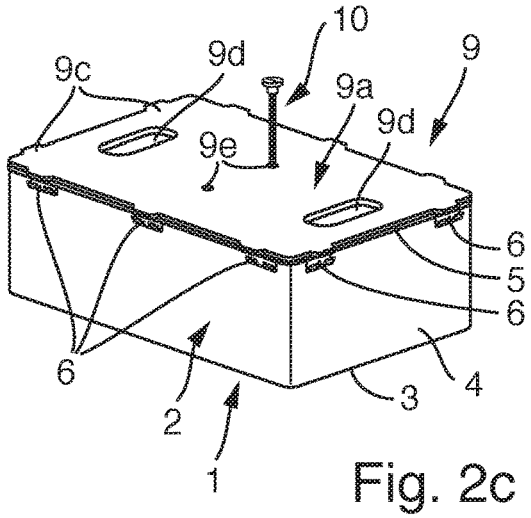
Figure 2B:
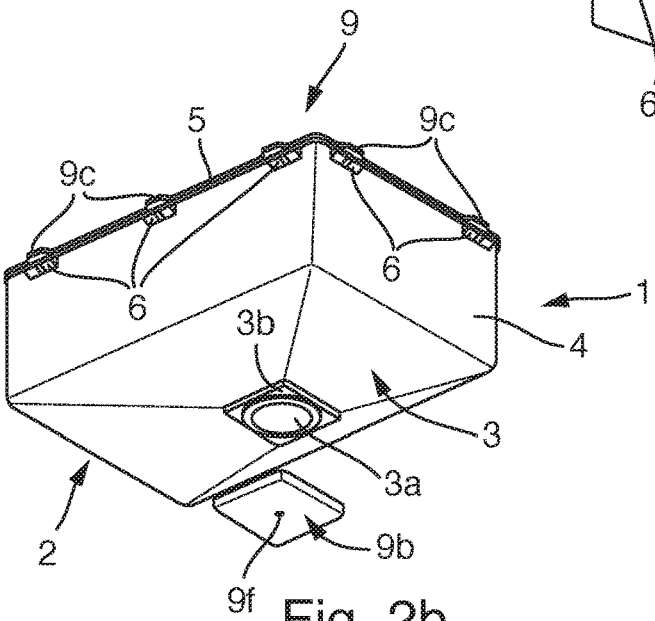
Figure 2C:
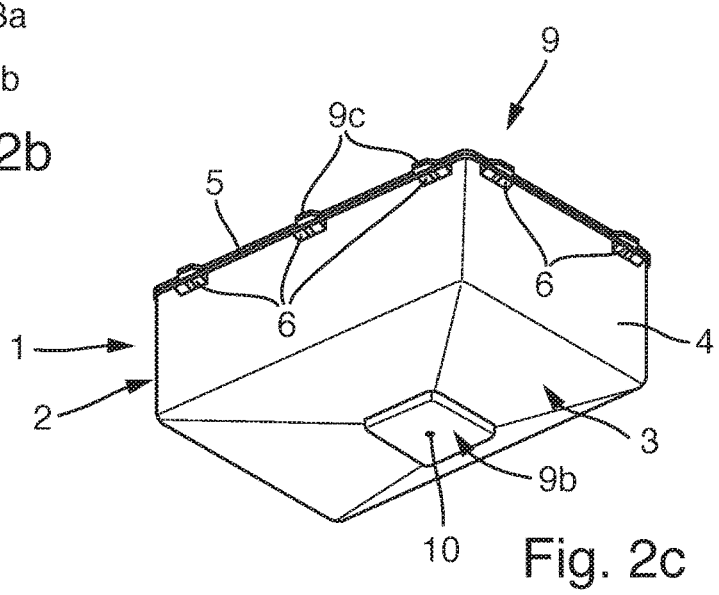

As can be gathered from FIG. 2*b*, the square-shaped counterpart 9*b* is placed over an outlet opening 3*a* of sink bottom wall 3. In this context, the overall dimensions of counterpart 9*b* are devised such that it completely covers said outlet opening 3*a*, without passing therethrough. Preferably, sink 1 has an edge contour 3*b* around said opening 3*b*, which contour 3*b* corresponds to a shape of the counterpart 9*b* in form fitting manner.

As can further be seen from FIG. 2*b*, said counterpart 9*b* has a central opening 9*f* which can be devised as a threaded bore.

FIG. 2*c* illustrates how a screw (or other connector) 10 can be inserted through opening 9*e* for connecting the installing jig 9*a* and its counterpart 9*b* mutually and in connection with the sink 1 (cf. FIG. 2*d*). To this end, the screw 10 is screwed into threaded bore 9*f* of counterpart 9*b*. In this way, the installing jig 9*a* and its counterpart 9*b* are securely and removably attached to sink 1, as shown in FIG. 2*d*. Sink 1 can then be manipulated by simply engaging grip openings 9*d*.

Figure 3:
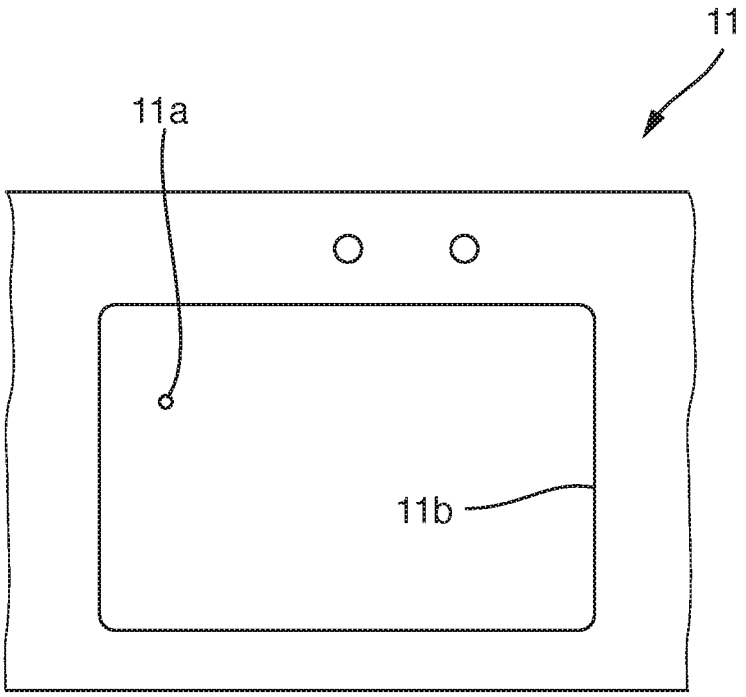
FIG. 3 shows a worktop with a cut-out, prior to installing a sink according to the present invention.

FIG. 3 shows a worktop 11 having an essentially rectangular cut-out 11*a*, which cut-out 11*a* is intended to be fitted with a sink 1 as described above in connection with FIGS. 1 and 2*a* through 2*d* as well as FIG. 6. To this end, the cut-out 11*a* is made larger in dimension than an area circumscribed by said rim but smaller than an envelope around said clamping elements in their uncompressed state while defining a cut-out side wall 11*b* extending essentially at right angles with respect to an upper and lower surface of said worktop. Worktop 11 can be made of wood, metal, stone or any other suitable (composite) material. It should be noted that the side wall 11*b* of cut-out 11*a* needs not to be polished or otherwise treated when installing sink 1 as described above by using an installation method according to the present invention.

Figure 4:
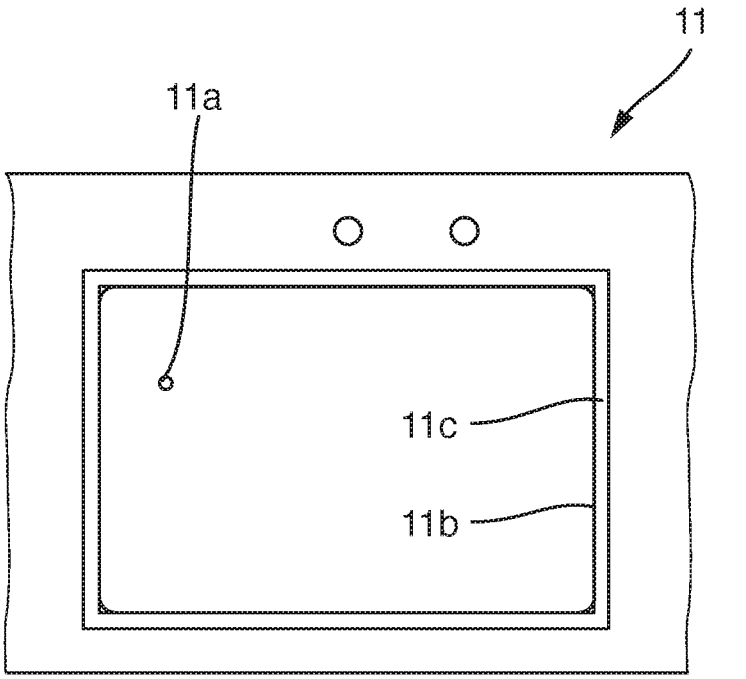
FIG. 4 shows the worktop of FIG. 3 after applying a removable protective cover according to a preferred method step.

According to FIG. 4, worktop 11 has been provided, adjacent a contour of cut-out 11*a*, with a removable protective cover 11*c* made from strips of a suitable tape material.

Figure 5:
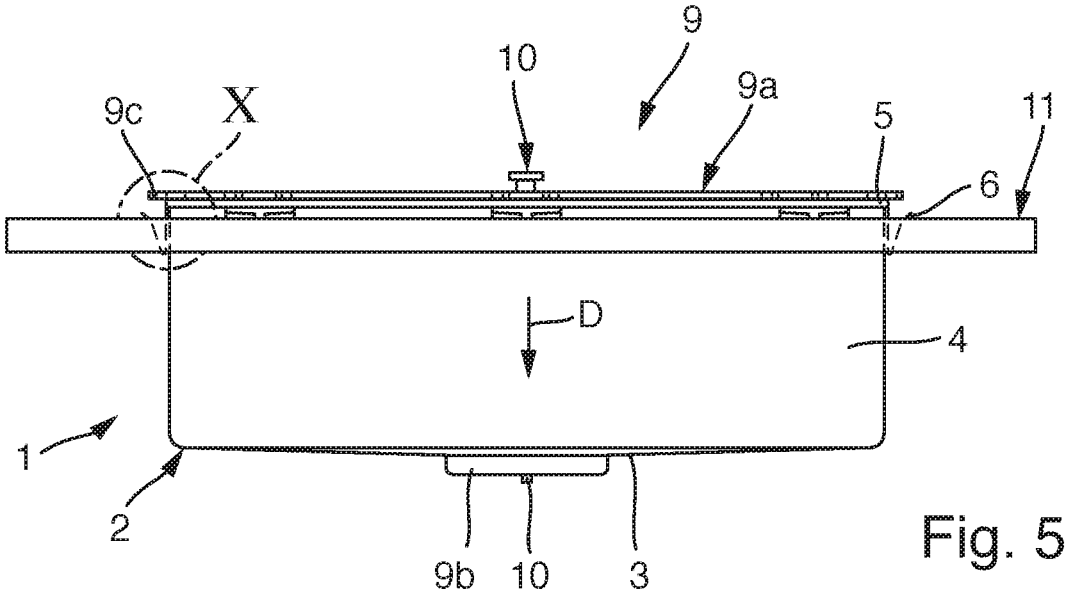
FIG. 5 shows an intermediate state during installation of the sink according to FIG. 1 or FIGS. 2*a* through 2*d* according to the inventive method.

Referring now to FIG. 5, sink 1 with installation device 9 and bead 8 (not shown; cf. FIG. 1) is inserted downwardly (arrow D) in the cut-out (cf. FIG. 3, 4) of worktop 11. In this way, as shown in FIG. 6, the clamping elements 6 are compressed by interaction with the cut-out side wall 11*b*, thus generating a force for holding sink 1 within the cut-out 11*a*. Methodwise, sink 1 is pushed downwardly D until the flaps 9*c* of installing jig 9*a* make contact with an upper surface 11*d* of worktop 11. Then, edge 5 of sink 1 is located within cut-out 11*a* opposite side wall 11*b*, and sealing material of bead 8 is located between said side wall 11*b* and said rim 5 for sealing a gap therebetween and for durably holding the sink after setting or curing of the adhesive sealing material, while further protecting side wall 11*b*.

Figure 7A:
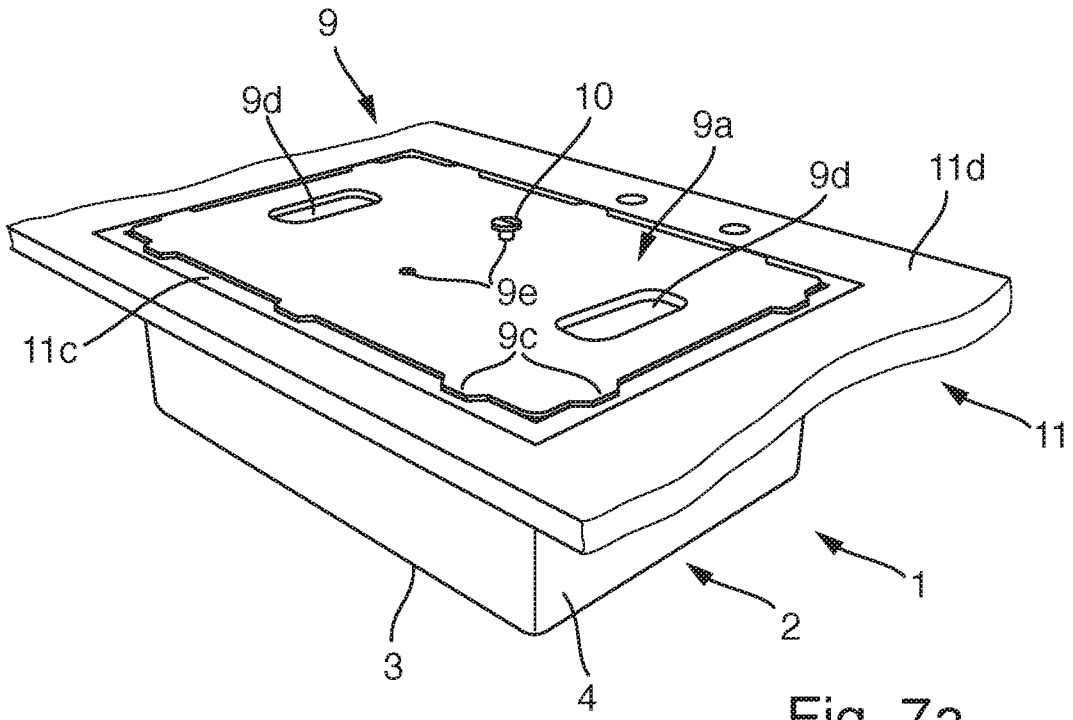
FIGS. 7*a* through 7*d* show successive method steps for completing the sink installation process.

FIG. 7*a* shows the state of the installation after said contact between installing jig 9*a* and worktop 11. An upper face or upper edge (not shown) of the sink rim is now coplanar with worktop upper surface 11*d*.

Figure 7B:
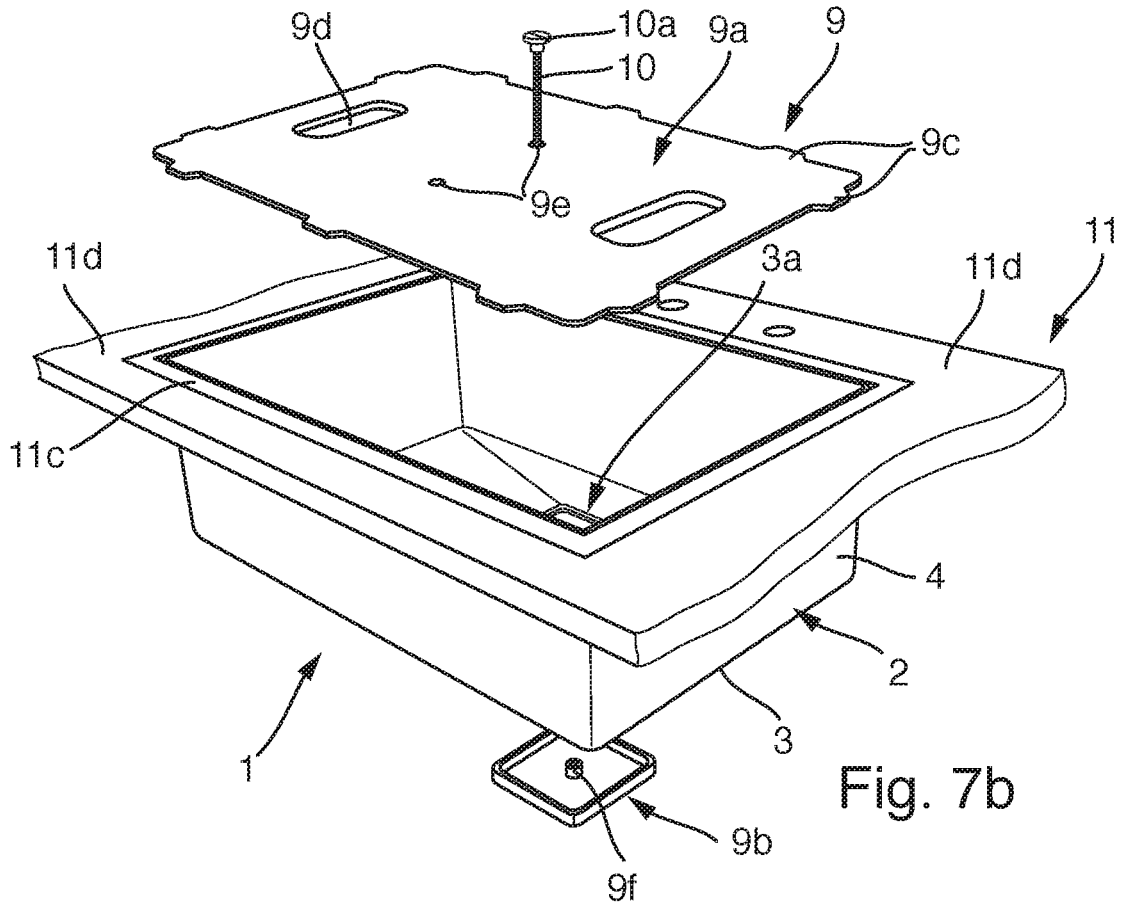

Then, according to FIG. 7*b*, connector or screw 10 is removed from installation device 9, thus separating installing jig 9*a* and its counterpart 9*b*. As can be easily gathered from FIG. 7*b* (cf. also FIG. 5 and FIG. 2*c*), connector 10 has an abutment 10*a* which comes into contact with installing jig 9*a* (cf. FIG. 7*a*) for defining a maximum distance between connected installing jig 9*a* and counterpart 9*b*.

Figure 7C:
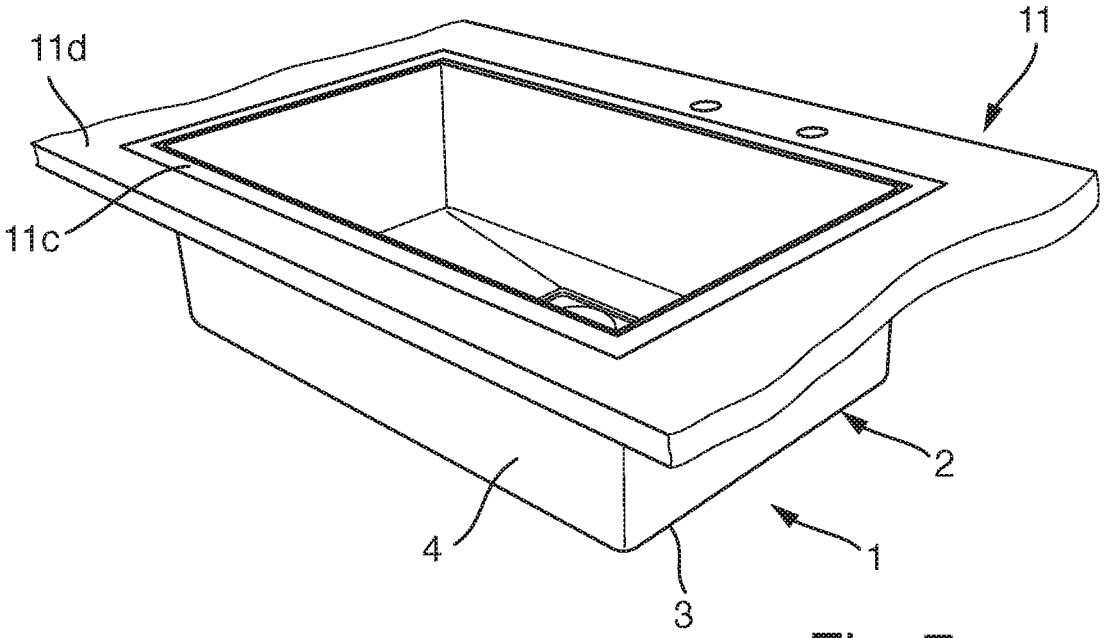

Then, according to FIG. 7*c*, the installation device 9 is completely removed from sink 1 on worktop 11.

Figure 7D:
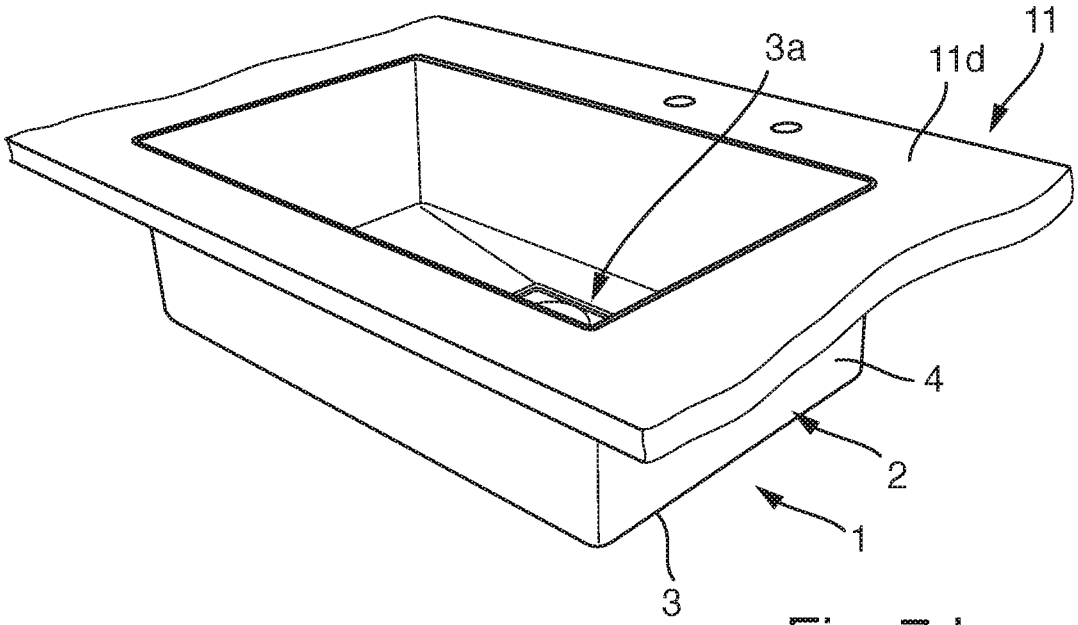

Finally, in the method step illustrated in FIG. 7*d*, the protective cover 11 is removed, thus achieving a complete workplace according to an aspect of the present invention. In this context, it should be checked whether or not the gap between the sink bowl and the worktop is filled properly with the sealing material. If not, some adjustment could be made. The clamping elements will hold the sink in position until the sealing material has dried (set or cured).

With reference to FIG. 1, the sealing material (silicone) could be applied with a bead diameter of approximately 7 mm all around the sink rim.

With respect to FIGS. 2*a* through 2*d*, said screw 10 can be devised with an M8 thread. The same holds for the threaded bore 9*f* of counterpart 9*b*.

Preferably, the dimensions of cut-out 10*a* according to FIGS. 3 and 4 should correspond to a sink bowl length+2 mm and to a sink bowl width+2 mm, respectively. However, any concrete dimensions will also depend on the respective dimensions of clamping elements 6 and rim 5 (extent E) according to FIG. 6.

Accordingly, protective cover 11*c* according to FIG. 4 could be applied with a respective width of 20 through 30 mm, without limitation.

The invention claimed is:

1. A workplace comprising a sink (1), said sink comprising:

at least one bowl (2) with a bottom wall (3) and a circumferential side wall (4);

at least one outlet opening (3*a*) located in said bottom wall (3);

a circumferential rim (5) located at an upper edge of said bowl (2) around an outside thereof, said rim (5) extending outwardly from said side wall (4) by a lateral extent (E);

a plurality of resilient clamping elements (6) arranged on the outside of said bowl (2) adjacent said rim (5), said plurality of clamping elements (6), in a free or uncompressed state thereof, extend outwardly beyond the lateral extent (E) of said rim (5), and said plurality of clamping elements (6) are configured to provide, in a loaded or compressed state thereof, a clamping force outwardly from said side wall (4);

a worktop (11), said worktop (11) having a cut-out (11*a*) therein, in which said sink (1) is installed, said cut-out (11*a*) defining a cut-out side wall (11*b*) extending at right angles with respect to an upper surface (11*d*) and a lower surface of said worktop (11), said cut-out side wall (11*b*) is located opposite said rim (5), and said sink (1) is centered within said cut-out (11*a*) by said plurality of clamping elements (6), which are compressed between said cut-out side wall (11*b*) and said sink (1); and an adhesive sealing joint located around an outward facing surface of said rim (5), between said sink (1) and said cut-out side wall (11*b*), and above said plurality of clamping elements (6), a distance or gap between said rim (5) and said cut-out side wall (11*b*) is uniform around said sink, and an upper face of said rim (5) defined along an outermost edge of the rim (5) is coplanar with said upper worktop surface (11*d*).

2. The workplace according to claim 1, wherein said rim (5) is configured in solid material or is configured by outward and downward bending of the side wall (4) material.

3. The workplace according to claim 1, wherein said plurality of clamping elements (6) are compressible inwardly toward said side wall (4) to an extent that said plurality of clamping elements (6) do not extend outwardly beyond said lateral extent (E) of said rim (5).

4. The workplace according to claim 1, wherein a clamping force per unit length of said side wall (4), as caused by said plurality of clamping elements (6) in said loaded or compressed state thereof, is evenly distributed around the sink (1), by at least one of adjusting a number of the plurality of clamping elements (6), a mutual spacing between individual clamping elements (6) of said plurality of clamping elements (6), or a clamping force of individual clamping elements (6) of said plurality of clamping elements (6).

5. The workplace according to claim 1, wherein said plurality of clamping elements (6) each comprise at least one spring element which is hook-shaped in cross section with a first leg (6*a*) extending parallel to said side wall (4) and downwardly from said rim (5), a second leg (6*b*) extending outwardly from said first leg (6*a*) and from said side wall (4), and a third leg (6*c*) extending outwardly from said second leg (6*b*) and from said side wall (4), said third leg (6*c*) at least partially overlapping with said first leg (6*a*).

6. The workplace according to claim 5, wherein a free end portion (6*d*) of said third leg (6*c*) is further angled outwardly from said side wall (4).

7. The workplace according to claim 1, wherein said cut-out side wall (11*b*) defines an opening that is larger than a perimeter defined by said lateral extent (E) of said rim (5).

* * * * *